US006079310A

United States Patent [19]

Yagla et al.

[11] Patent Number: 6,079,310

[45] Date of Patent: Jun. 27, 2000

[54] PORTABLE LAUNCHER

[75] Inventors: Jon J. Yagla, King George; Richard E. Miller, Jr., Fredericksburg; Robert W. Lowery, King George; John W. Powers, Falls Church, all of Va.

[73] Assignee: The United States of America as represented by the Secretary of the Navy, Washington, D.C.

[ * ] Notice: This patent is subject to a terminal disclaimer.

[21] Appl. No.: 09/070,770

[22] Filed: Apr. 30, 1998

Related U.S. Application Data

[63] Continuation-in-part of application No. 08/772,054, Dec. 5, 1996, Pat. No. 5,837,919.

[51] Int. Cl.[7] ..... F41F 3/052

[52] U.S. Cl. ..... 89/1.816; 89/16

[58] Field of Search ..... 89/1.816, 1.817, 89/1.818, 1.806, 1.807, 1.8, 14.1, 16

[56] References Cited

U.S. PATENT DOCUMENTS

| | | | |
|---|---|---|---|
| 2,767,464 | 10/1956 | Nack et al. | 89/16 |
| 2,802,399 | 8/1957 | Little . | |
| 2,925,013 | 2/1960 | Santora et al. | 89/1.8 |
| 2,956,478 | 10/1960 | Ream, Jr. et al. . | |
| 2,998,754 | 9/1961 | Bialy . | |
| 3,002,342 | 10/1961 | Schatzki | 60/230 |
| 3,015,991 | 1/1962 | Forbes, Jr. | 89/1.816 |
| 3,026,775 | 3/1962 | Musser . | |
| 3,160,060 | 12/1964 | Zsoka et al. . | |
| 3,295,411 | 1/1967 | Lehmann | 89/1.81 |
| 3,499,364 | 3/1970 | D'ooge | 89/1.817 |
| 4,796,510 | 1/1989 | Piesik | 89/1.816 |
| 4,802,930 | 2/1989 | Kessler | 420/420 |
| 4,911,060 | 3/1990 | Greenspan et al. | 89/16 |
| 4,934,241 | 6/1990 | Piesik | 89/1.817 |
| 5,012,718 | 5/1991 | Miller | 89/1.816 |
| 5,106,034 | 4/1992 | Yagla et al. | 244/3.24 |
| 5,149,906 | 9/1992 | August | 89/1.809 |
| 5,170,005 | 12/1992 | Mabry et al. | 89/1.809 |
| 5,194,688 | 3/1993 | Piesik | 89/1.816 |
| 5,473,886 | 12/1995 | Leburn | 60/230 |
| 5,837,919 | 11/1998 | Yagla et al. | 89/1.816 |

FOREIGN PATENT DOCUMENTS

| | | | |
|---|---|---|---|
| 1801614 | 6/1970 | Germany | 89/1.816 |
| 431245 | 2/1948 | Italy | 89/14.1 |
| 445053 | 2/1949 | Italy | 89/1.816 |
| 445101 | 2/1949 | Italy | 89/1.816 |
| 316189 | 9/1956 | Switzerland . | |
| 2105826 | 3/1983 | United Kingdom | 89/1.8 |
| 2124741A | 2/1984 | United Kingdom | 89/1.817 |

OTHER PUBLICATIONS

J.J. Yagla, "Concentric Canister Launcher," published in *Naval Engineers Journal*, May, 1997 313–330.

C. Baumann et al, "An Arsenal Ship Design," published in *Naval Engineers Journal*, Nov., 1997 85–94.

*Primary Examiner*—Stephen M. Johnson

*Attorney, Agent, or Firm*—James B. Bechtel, Esq.; John P. McMahon, Esq.

[57] ABSTRACT

A launcher is disclosed having means for directing and concentrically spreading, as well as dispersing, exhaust gases created by an internal combustion of an object, such as a missile, that is operatively launchable therefrom. The concentric duct provides the directing, spreading and dispersing means and cooperates with a cup having means to arrange a port in operative relationship with an exhaust outlet of the object being launched. The cup which mates with the concentric duct has one of its ends open to the ambient so that the exhaust gases are lead into and out of the concentric duct so as to be concentrically dispersed into the atmosphere.

11 Claims, 7 Drawing Sheets

FIG.9
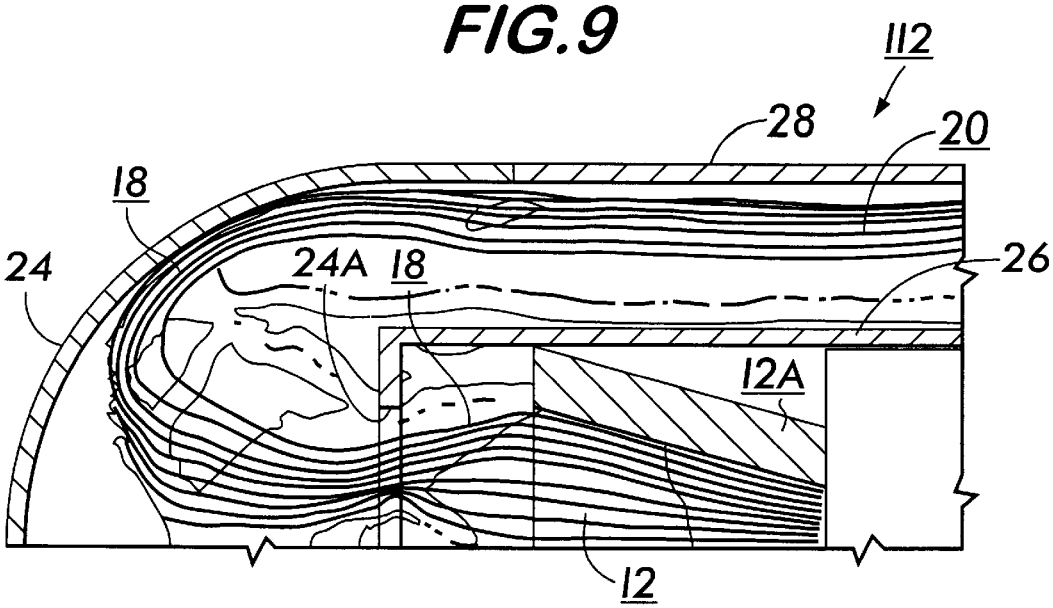
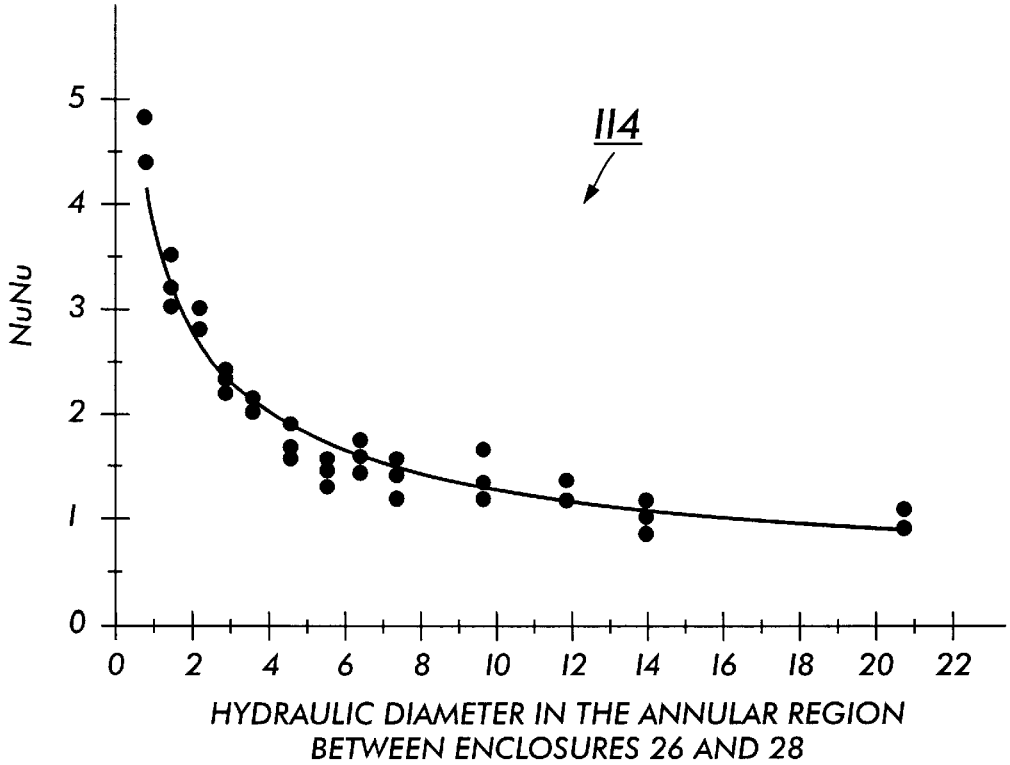
FIG.10

PORTABLE LAUNCHER

CROSS-REFERENCE TO RELATED APPLICATION

This application is a continuation-in-part of U.S. patent application Ser. No. 08/772,054 filed Dec. 5, 1996 now U.S. Pat. No. 5,837,919. +gi

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1.0) Field of the Invention

The present invention relates to a launcher for launching missiles, torpedoes, sensors, or counter measures and, more particularly, to a launcher devoid of moving parts having a concentric duct for collecting and dispersing exhaust gases produced by the launch device.

(2.0) Description of the Related Art

In addition to the harsh operational conditions involved in military applications, launchers used for launching missiles, torpedoes, sensors and countermeasures typically find themselves in environments that tend to corrode the launcher itself. In spite of such conditions, the launcher must be made operationally ready within the shortest possible time, and without the need of undue preventive maintenance. Launchers which employ moving parts hinder the obtainment of these operational readiness desires.

Existing launchers, particularly those used for shipboard applications, either use a relatively heavy plenum carrying an uptake device to capture and direct, in an upward manner, exhaust gases of the launched device, or are lacking in a proper uptake mechanism so that the exhaust gases tend to impend on the deck of ship. None of these existing launchers satisfies the needs of shipboard launchers. It is desired to provide a launcher that does not suffer the drawbacks of prior art devices.

OBJECTS OF THE INVENTION

It is a primary object of the present invention to provide a launcher devoid of moving parts.

It is another object of the present invention to provide a launcher comprised of a material that does not suffer from corrosion, even when subjected to seawater or exhaust gases.

It is a further object of the present invention to provide a lightweight launcher so that it may be more easily handled.

Furthermore, it is an object of the present invention to provide a launcher that is arranged so that it may be easily modified to adapt to the various parameters of different missiles, torpedoes, sensors, countermeasures or other objects that are to be launched therefrom.

SUMMARY OF THE INVENTION

The invention is directed to a launcher devoid of moving parts and having a concentric duct that collects and concentrically disperses exhaust gases created by the object being launched from the launcher.

The launcher comprises first and second enclosures and a cup. The first enclosure has a wall that extends longitudinally and has interior and exterior surfaces with the interior surface encompassing and housing a launchable object having an exhaust outlet. A support means has first and second faces separated from each other by a first predetermined distance to define an exhaust discharge region. One of the faces is affixed to the exterior surface of the first enclosure. The second enclosure has a wall that extends longitudinally and has interior and exterior surfaces with the interior surface affixed to the other face of the support means. The cup has a port at its central portion that is in operative relationship with the exhaust outlet of the launchable object being propelled. The port allows exhaust gases of the launchable object to be directed into the discharge region. The cup also has a rim that mates with the wall of the second enclosure.

BRIEF DESCRIPTION OF THE DRAWINGS

A better understanding of the present invention may be realized when considered in view of the following detailed description, taken in conjunction with the accompanying drawings.

FIG. 9 illustrates a reverse image of a computational fluid dynamics (CFD) resulting from the flow of rocket exhaust through the shipboard launcher of FIG. 1.

FIG. 10 illustrates data that may be used to determine a Nusselt number relationship of the shipboard launcher of FIG. 1.

DETAILED DESCRIPTION OF THE PREFERRED EMBODIMENTS

Figure 1:
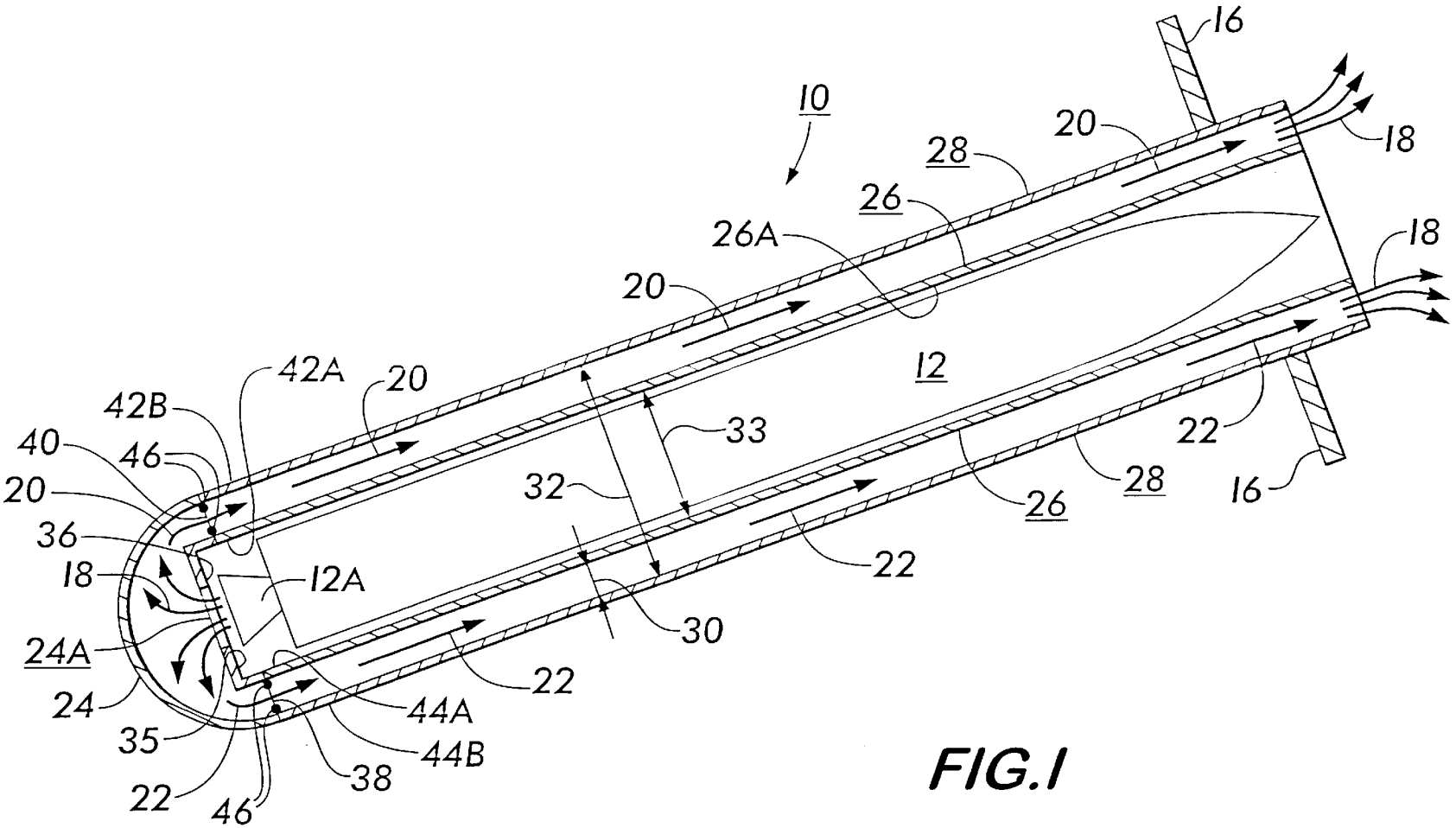
FIG. 1 is a schematic of the launcher of the present invention.

Referring to the drawings wherein the same reference number indicates the same element throughout, there is shown in FIG. 1 a launcher 10 having a concentric gas management system and having means for being flush or level shock mounted to the deck of a ship, thus, eliminating the need for a foundation level support structure while at the same time reducing the shock delivered to an object 12, such as, a missile, torpedo, sensor or countermeasures, when it is being launched out of the launcher. The concentric management system is accomplished by a concentric duct 14 that is, as seen in FIG. 1, devoid of separate plenums and uptake structures commonly found on prior art devices.

In general, the launcher 10 has a circular pressure vessel for both thrust augmentation gas pressure and internal pressure in the duct. The duct has a round shape, preferably circular or spherical, to serve as an efficient pressure vessel. In the practice of the invention, by means of computer simulations of compressible fluid dynamics and finite element stress analysis, it has been determined that concentric circular shapes are correct for producing a minimum weight structure with thrust augmentation (gun-like phenomenon created when gases are produced in excess of what can be vented by the port, causing internal pressure and a gun effect). The restriction in the base port of the launcher 10 may be so severe as to provide thrust augmentations several times the thrust of the launchable object or missile. The launcher 10 has an inner cylinder that provides a pressure vessel for the thrust augmentation gas. The pressure of the gas flowing between the cylinders in the present invention, that is, between the first and second enclosures 24 and 26, to be described, also must be withstood by the outer cylinder (enclosure 28) and partially offsets the augmentation pressure in the inner cylinder (enclosure 26). The launcher 10 provides concentric pressure vessels for management of the exhaust gas pressure and thrust augmentation pressure and also serve as ducts to convey the exhaust gases out of the launcher 10. The present invention preferably having a hemispherical cup 24 placed at one end of a concentric cylinder, formed by the first and second enclosures 26 and 28 respectively, eliminates so called "transient pressure peaks" known in the art.

The concentric duct 14 of FIG. 1 serves as a means for collecting and dispersing exhaust gases created by the launchable object 12. The concentric duct 14 preferably comprises a titanium alloy having a trade name of TIMET 21S. The titanium alloy is advantageous because of its weight which is approximately 40% of that of stainless steel which, in turn, provides a relatively lightweight launcher 10. The titanium alloy is advantageously impervious to seawater corrosion, has high strength (140 ksi), has stiffness and a capability of withstanding high temperatures of up to 1500° F. on a continuous basis.

The concentric duct 14 is held in place by at least one plate 16 preferably comprised of the previously mentioned titanium alloy and dimensioned to snugly fit about the exterior surface of the concentric duct 14. The plate 16 may be used as a chock for stacking a plurality of launchers 10 in stowage and ganging a plurality of launchers 10 together in a shipboard launcher configuration. The plate 16 eliminates the need to provide a stand with a flat base to stack launcher devices, but rather the plates 16 may act as interlocking plates to serve as chocks to join shipboard launchers together. The chocks or plates 16 are designed to be joined to the first and second enclosures 26 and 28, as to be described, with a simple girth weld using an automated pipe welding machine. Other means, such as press fitting and adhesives could also be used.

In shipboard launcher system configurations, the plates 16 may be located at stations part of the way up and down the launcher axis of the shipboard system, they need not be at the base of the shipboard launcher. The location of the plates 16 is determined by shock and vibration criteria, not the criteria for a design of a stand. The usage of the plates 16 has no solid object moving in the void between the inner and outer closures (enclosures 26 and 28 respectively) of a system configuration, thereby allowing the use of rigid plate material for plate 16 to be placed in contact with the outer closure (enclosure 28). No omni-directional elastic materials are required to be used in the mounting of plate 16. The usage of the plates 16 eliminates any unbalanced axial and rotational forces that might otherwise degrade the operation of the shipboard launcher system in which the launcher 10 finds application.

The concentric duct 14 of FIG. 1 collects the exhaust gases, represented by directional arrows 18, generated by a launchable object 12, directs the exhaust gases 18 in an upward manner as indicated by directional arrows 20 and 22, and allows the collected exhaust gases 18 to be dispersed, in a concentric manner, from the open end of the concentric duct 14 into the ambient. The directing of the exhaust gases 18 is accomplished, in part, by a cup 24 preferably comprised of the twice mentioned titanium alloy and having a port 24A that is in operative fluid communication with a duct 12A of the launchable object 12. The port 24A allows for the egress of exhaust gases 18 created by the launchable object 12 when it is being launched. The thrust augmentation during the egress of the exhaust gases 18 is controlled by the size of the duct 12A and the port 24A.

The concentric duct 14 is formed by the first enclosure 26 and the second enclosure 28. The first enclosure 26 has a wall that extends longitudinally along the launcher 10 and has an interior surface 26A and an exterior surface 26B with the interior surface 26A encompassing and housing the launchable object 12. The second enclosure 28 has a wall that extends longitudinally along the launcher 10 and is in correspondence with the wall of the first enclosure 26. The wall of the second enclosure 28 has interior and exterior surfaces 28A and 28B respectively. The first and second enclosures 26 and 28 are spaced apart from each other by a distance 30 defined by a slat arrangement to be described with reference to FIG. 2. The annular spacing between the first and second enclosures 26 and 28 define the exhaust discharge region. The opposite interior surfaces 28A are spaced apart from each other by a distance 32 and the opposite interior surfaces 26A are spaced apart from each other by a distance 34 which also corresponds to the internal bore of the launcher 10.

The cup 24 preferably has a hemispherical shape and has ledge portions 35 and 36 that are separated from each other so as to define the port 24A. The ledge portions 35 and 36 are respectively connected to stems 38 and 40 each of which is joined to the rim of the cup 24. The stems 38 and 40 are selected so as to adequately support the ledges 35 and 36 yet allow the exhaust gases 18 to pass, in directions 20 and 22, thereby to enter the space, defined by the distance 30, between the first and second enclosures 26 and 28. The cup 24, in particular its stem portions 38 and 40, mate with portions 42A and 44A of the first enclosure 26 and 42B and 44B of the second enclosure 28. The stem portions 38 and 40 may be joined to the first and second enclosures 26 and 28 by laser welds generally indicated by dots 46. Laser welding is particularly suited to the practice of the invention because the mating surfaces of the launcher 10 are primarily continuous and further details of laser welding is described in U.S. Pat. No. 5,106,034 of J. J. Yagla, et al and is herein incorporated by reference. The formation of the launcher 10 may be further described with reference to the exploded perspective view of FIG. 2.

Figures 2A, 2B, 2C, 2D, 2E:
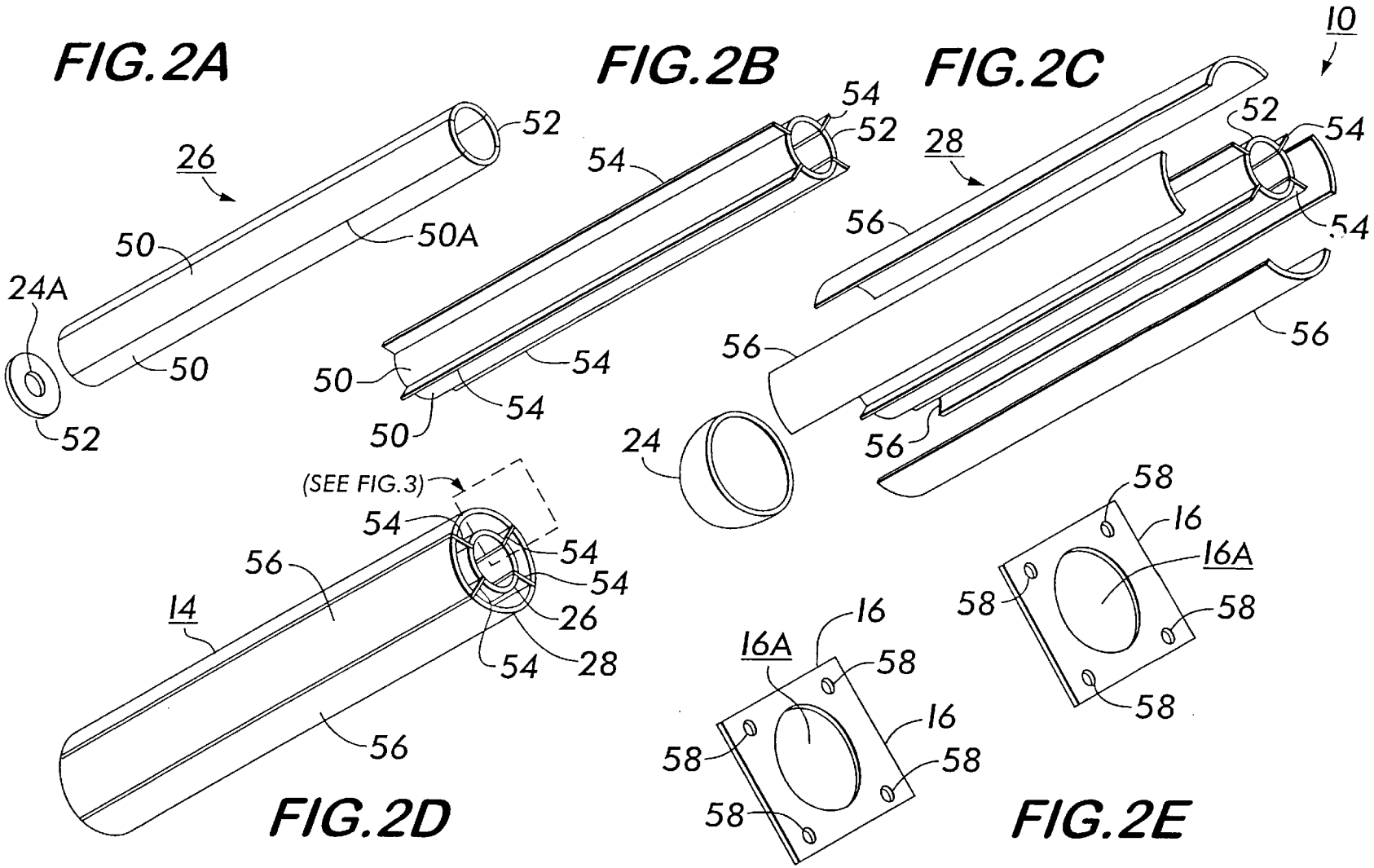
FIG. 2 is composed of FIGS. 2(A), 2(B), 2(C), 2(D) and 2(E) that cumulatively represent an exploded perspective view of the launcher of FIG. 1.

FIG. 2 is composed of FIGS. 2(A), 2(B), 2(C), 2(D) and 2(E) which cumulatively illustrate the sequential steps of forming the launcher 10. FIG. 2(A) illustrates the first enclosure 26 as being formed by a plurality of members 50, preferably four (4) members, that are held together by at least one, but preferably two (2) retaining rings 52, that respectively encompass each end of the first enclosure 26. If desired, the port 24A of cup 24, described with reference to FIG. 1, may be introduced into one of the retainers 52 as shown in FIG. 2. Further, if desired the four members 50 making up the first enclosure 26 may be separated from each other so that a gap 50A is provided therebetween which accommodates the insertion of a plurality of support members 54, preferably four (4) and arranged as shown in FIG. 2(B). Alternatively, the first enclosure 26 can be formed as a pipe or extruded so as to include the four (4) members 50 as integral parts.

The support members 54 have first and second faces with one of the faces affixed to the exterior surface of the first enclosure 26, preferably by means of the gap 50A and joined thereto by a laser weld. The other face of the support members 54 mate with a plurality of members 56, preferably four (4), which make up the second enclosure 28 as shown in FIGS. 2(C) and 2(D).

FIG. 2(C) illustrates the four preferred members 56 arranged so as to be placed into contact with the second face of the support members 54, but before such contact is accomplished, the hemispherical cup 24 is positioned in place at the bottom end, as viewed in FIG. 2(C). The four (4) support members 54 are preferably slats which serve in a similar manner as that of a longeron comprising fore-and-aft framing members of an airplane fuselage. The four (4) members 56 are merged onto the slats 54 to form the concentric duct 14 as shown in FIG. 2(D). Alternatively, the second enclosure 28 can be formed as a pipe or extruded so as to include the members 54 as integral parts. The first enclosure 26 is positioned within the second enclosure 28 by means of parallel slats 54 for launchers of missiles with fins protruding from the body. For missiles without fins protruding from the body a single slat 54 suffices to locate the first enclosure, and additional slats can be provided as required for additional strength. It is preferred that the slats 54 be either parallel, or on radials. Further, it is preferred to put the slats 54 as closely together as practical, so as to maximize the free area between the first and second enclosures 26 and 28. Laser welding can be used to blind-weld the support 54 members to the pipe from the outside in a manner to be described hereinafter with reference to FIG. 4.

FIG. 2(E) illustrates the oppositely disposed plates 16 as having a bore 16A which snugly fits over the outer surface of the concentric duct 14. The plates 16 further have apertures 58 which accept fastening members so that the launcher 10 may be fastened onto a structure, such as a deck or ledge of a ship, allowing the launcher member 10 to be rigidly affixed to an appropriate surface thereby allowing the launchable object, such as the missile 12 shown in FIG. 1, to be launched without delivering excessive shock thereto. Plates 16 are also provided with edge fasteners so that several launchers 10 can be ganged together for more convenient handling of a large number of weapons, or comprise a "clip" of weapons for loading into a ship.

Figure 3A:
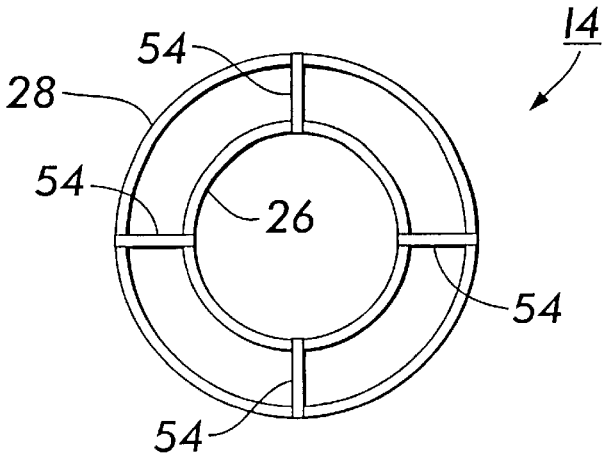
FIG. 3 is composed of FIGS. 3(A), 3(B) and 3(C) that illustrates an effective I-beam arrangement between the inner and outer side walls that form a concentric duct of the launcher of the present invention.
Figure 3B:
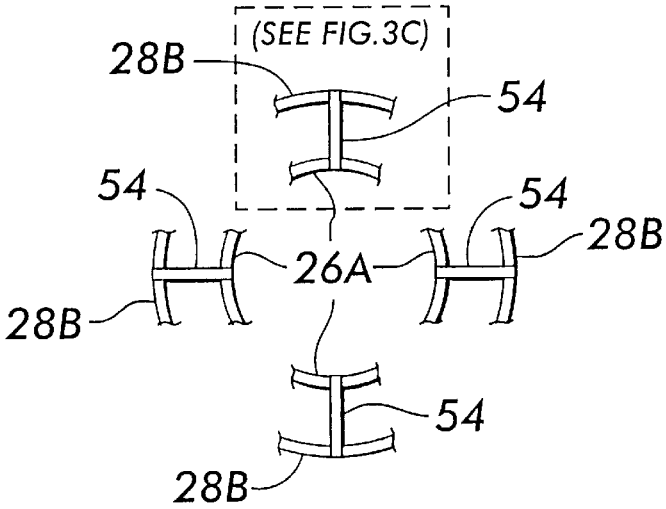
Figure 3C:
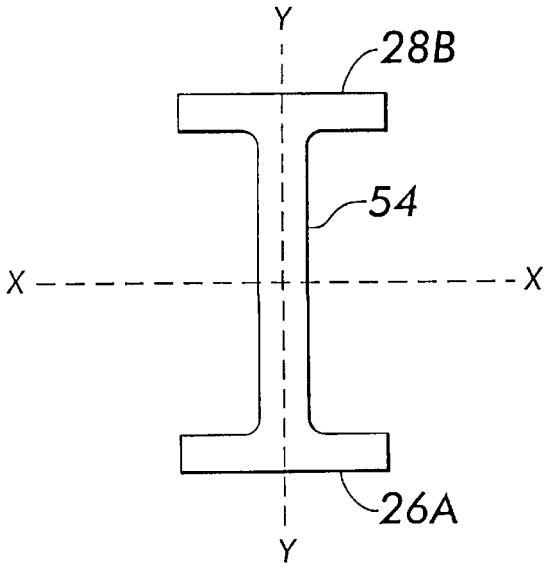

As seen in FIG. 2, the elements 50 making up the first enclosure 26 and the elements 56 making up the second enclosure 28 are all preferably cylindrical shape, have continuous surfaces, and are relatively easily welded together by the use of laser welding. The slat members 54 serve as I-beams to improve the structural integrity of the launcher 10 and may be further described with reference to FIG. 3. FIG. 3 is composed of FIGS. 3(A), 3(B) and 3(C). FIG. 3(A) illustrates that the slats 54 provide the means for separating the first enclosure 26 from the second enclosure 28. FIG. 3(B) shows only the portions of the first and second enclosures 26 and 28 and that the slat 54 may be equated to an I-beam analogy. FIG. 3(C) illustrates the I-beam member of the present invention formed by the slat 54 serving as the support means of the launcher 10 of FIG. 1.

FIG. 3 generally illustrates that the interrelationship between the first and second enclosures 26 and 28, wherein the slats 54 provide a cross-section which is substantially I-shape. The arrangement shown in FIG. 3 illustrates that the slat 54 serves as an I-beam that advantageously distributes the stresses that the launcher 10 encounters uniformly across the width of the I-beam.

As seen in FIG. 3(C) the width or thickness of the slat 54 serves as the web of the I-beam having a top surface 28B and a bottom surface 26A. The slat 54 is preferably comprised of titanium alloy, previously discussed for the concentric duct 14, and has a typical thickness of 0.01" to provide, in a manner known in the art, for a lightweight structure of very high bending strength. The I-beam arrangement provided by the slat 54 allows the launcher 10 to withstand relatively high stress conditions and still maintain its strength. In operation, and with respect to FIG. 1, the launcher 10 provides for a concentric gas management of the exhaust fumes 18 by the use of the annular space, defined by distance 30 as shown in FIG. 1, between the two concentric cylinders 26 and 28 which cooperatively act as a concentric duct to discharge the exhaust fumes 18 created by the missile 12 during its firing. The exhaust fumes 18 pass from the duct 12A of the missile 12 through the port 24A (preferably of cup 24) and then against the cup 24. The exhaust gases 18 created by the missile 12 flow downward but are turned 180° by the hemispherical cup 24 and redirected, in the directions indicated by directional arrows 20 and 22, into the annular space defined by the distance 30. Thrust augmentation during egress of the exhaust gases 18 is controlled by the size of the port 24A of cup 24 and also of the duct 12A of the missile 12. The exhaust gases 18 are steered and directed through the concentric duct 14 so that they may be dispersed, in a concentric manner, from the launcher 10 from the open end of the duct 14 and into the ambient.

It should now be appreciated that the practice of the present invention provides for a relatively lightweight launcher having no movable parts and formed of a material that is relatively insensitive to corrosive conditions normally caused by seawater. The launcher of the present invention utilizes concentric gas management and has plates to allow it to be rigidly affixed to a surface to accommodate launching conditions.

Figure 4:
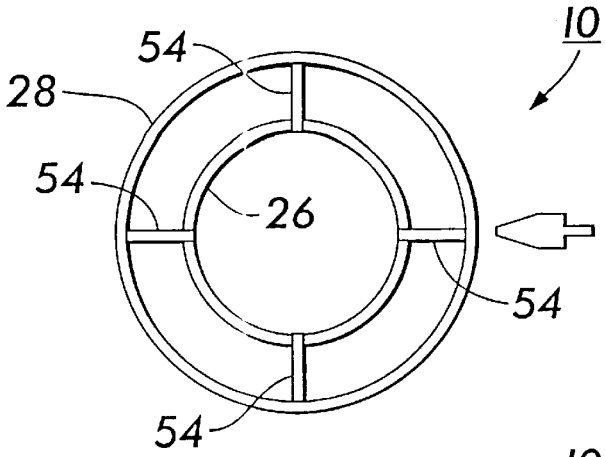
FIG. 4 is composed of FIGS. 4(A), 4(B) and 4(C) respectively illustrating three (3) different rigid connecting means that may be accomplished by blind welding techniques related to the present invention.
Figure 5:
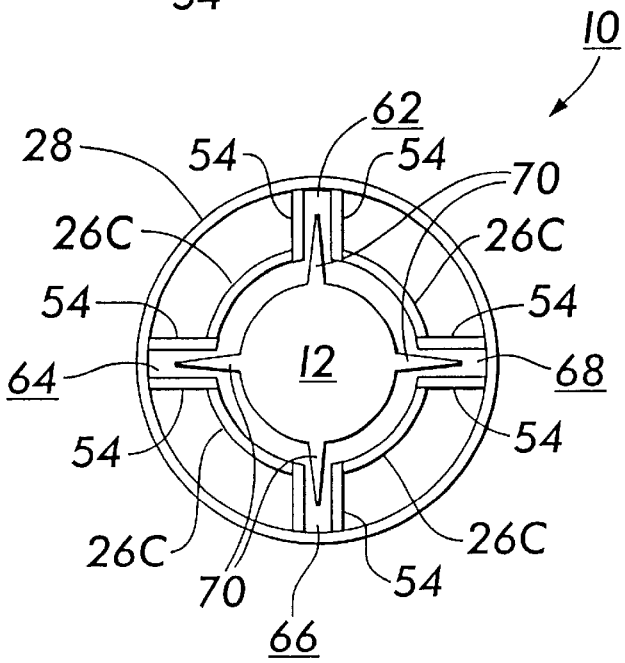
FIGS. 5 and 6 illustrate an arrangement of the inner enclosure of the launcher that accommodates various needs.
Figure 6:
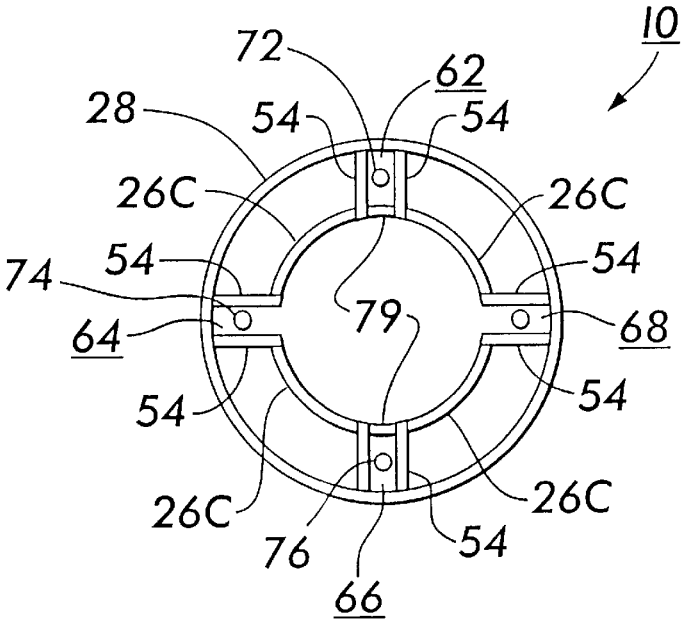

The present invention has additional embodiments shown in FIGS. 4–6 that accommodate different needs and manufacturing techniques associated with the launcher 10 such as the previously mentioned blind welding technique shown in FIG. 4.

FIG. 4 schematically illustrates the same elements already described with reference to FIG. 3(A), but in addition thereto, illustrates a laser beam 60 that is focused on and pierces the second enclosure 28 to provide for the blind welding, previously mentioned, of the slats 54 to the first and second enclosures 26 and 28. More particularly, FIG. 4 shows three configurations FIGS. 4(A), 4(B) and 4(C) for the longitudinal slats. More specifically, FIG. 4(A) illustrates a simple slat 54 established with a blind laser welding 60. FIG. 4(B) illustrates an extruded fin guide 55 with rabbets used for erecting enclosures in operative cooperation with blind laser welding techniques. FIG. 4(D) illustrates an extruded slat 54 with rabbets 54A and 54B. The slats 54 of FIG. 4(D) are rabbetted (54A and 54B) to facilitate erection of the launcher in operative cooperation with blind laser welding techniques.

When blind welding is performed, jigs hold the slats 54 in place, the enclosure panels, such as the first and second enclosures 26 and 28, are placed on the rabbets 54A and 54B and laser 60 or other automatic welding completes the manufacturing. The welded assemblies are very stiff in bending. The slat 54 having the preferred I-beam configuration is very strong, as it develops a large area moment of inertia in its flanges. The concentric enclosures, such as enclosures 26 and 28, build on this technique by essentially moving the I-beams out to the outer radius of the launcher, where the parallel axis theorem assures for an even greater flexural rigidity proportional to the square of the radius of the launcher. The slats 54 are continuously welded in such a way as to provide a rigid, substantially perfectly straight, shock resistant structure, serving as the launcher 10.

FIG. 5 illustrates the launcher 10 as comprised of a continuous second enclosure 28 and first enclosure 26 that is comprised of sections 26C that are spaced apart from each other. FIG. 5 further illustrates that the support means 54, connecting the second enclosure 28 to the first enclosure comprised of sections 26C, comprises a plurality of slats 54 arranged into a plurality of groups with each group comprising a pair that are spaced apart from each other by a first predetermined distance. The plurality of the group of slats 54 is preferably four (4) and corresponds to the number of sections 26C. The predetermined distance between each pair of slats 54 is selected to define chambers 62, 64, 66 and 68. The chambers 62, 64, 66 and 68 are dimensioned to accommodate the different needs of the launcher 10. More particularly, as seen in FIG. 5, the chambers 62, 64, 66 and 68 are dimensioned, for one application, to accommodate the passage of fins 70 of missile 12 as the missile 12 is being launched from launcher 10.

FIG. 6 illustrates the same structural arrangement of the launcher 10 of FIG. 5, but with the missile 12 removed therefrom. More particularly, FIG. 6 illustrates the chambers 62, 64, 66 and 68 as housing devices 72, 74, 76 and 78, respectively. The devices 72, 74, 76 and 78 may be of various types. For example, device 72 may actually be an electrical cable way, device 74 may be an electronic device, device 76 may be a sprinkler for emitting fluid, such as water, and device 78 may be a duct for removing fluid. The chambers can be open as shown for chambers 64 and 68, or closed by a spectrum 79 as shown for chambers 62 and 66.

It should now be appreciated that the present invention, in addition to providing a lightweight launcher, provides a launcher that accommodates various needs for various environments in which a launcher may be used.

The launcher 10 possessing a self-contained gas management provides a complete shipboard launching system for the missile it contains and may be further described with reference to FIG. 7.

Figure 7:
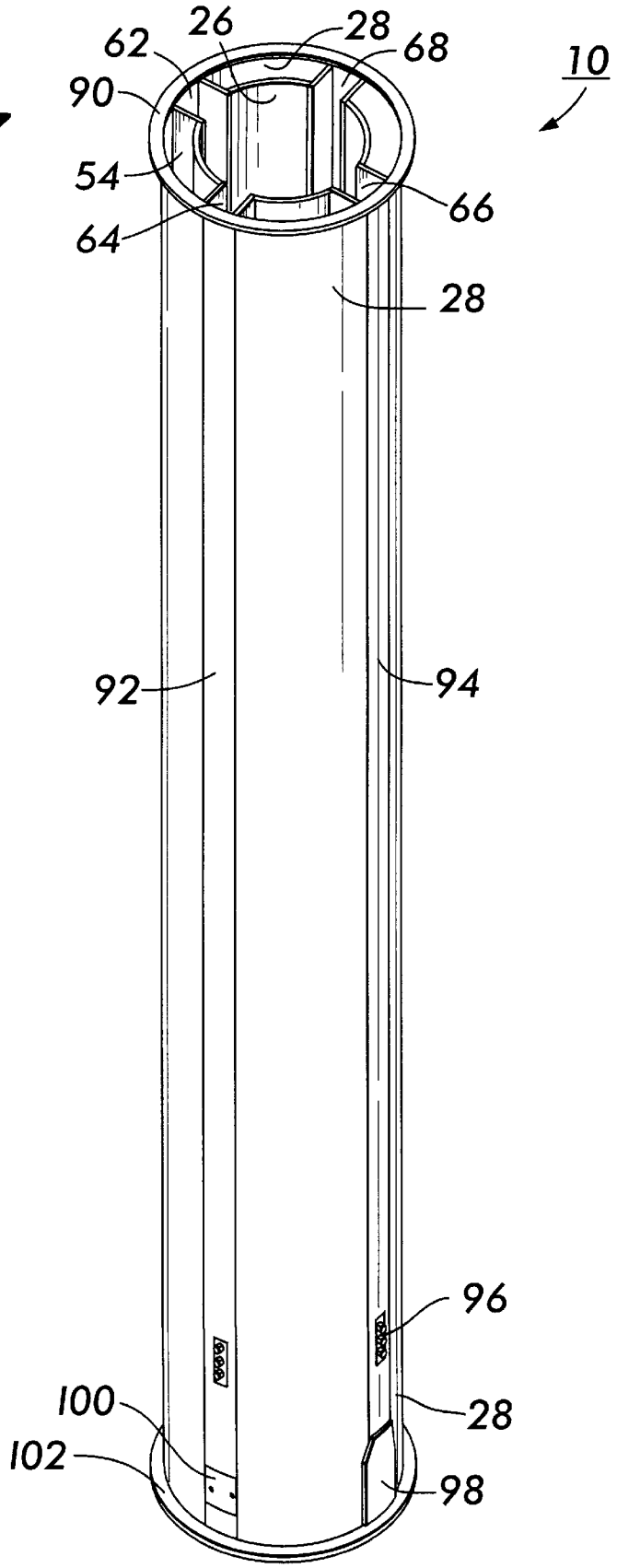
FIG. 7 illustrates a typical shipboard launcher system provided by the present invention.

FIG. 7 illustrates the launcher 10 as not being coupled to its hemispherical cup 24, but showing many of the elements previously discussed with reference to FIGS. 1–6. FIG. 7 further illustrates the typical shipboard launcher 10 as comprising elements, known in the art; i.e., a flange, forward canister 90, a fin pocket 92, a fin pocket 94, a boss, shock 96, a pocket taper cover 98, a lateral restraint block 100, and a flange, aft canister 102. The launcher 10 in its typical configuration used for facilitating the launching of a missile may be further described with reference to FIG. 8.

Figure 8:
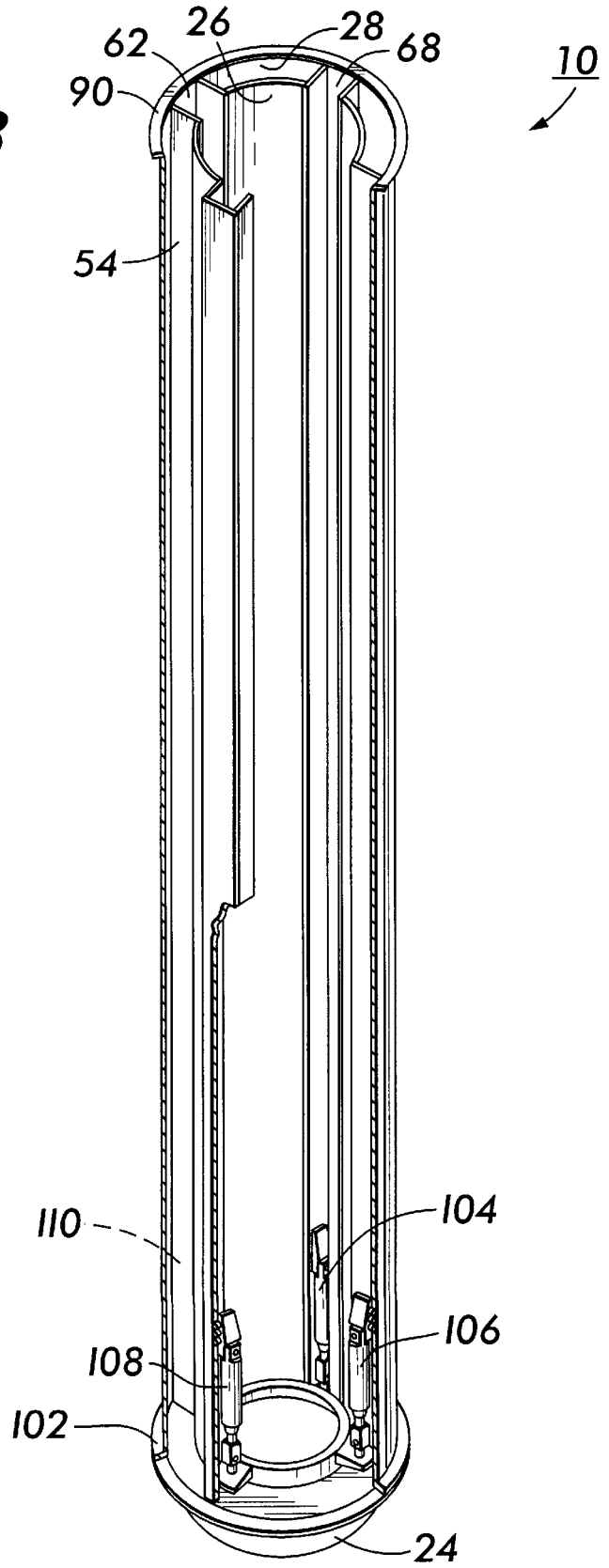
FIG. 8 is a cut-away view of FIG. 7 but having a spherical cup at one of its ends and showing a typical shock mounting arrangement that may be provided for the shipboard launcher.

FIG. 8 illustrates the launcher 10 as being coupled to its hemispherical cup 24 by means of the flange, aft canister 102. FIG. 8 is a cut-away view of launcher 10 so as to more clearly illustrate the inner confines of launcher 10, and to show a typical shock mounting arrangement for the launcher 10 provided by shock absorber members 104, 106, 108 and 110 (not shown).

Analysis of Shipboard Launcher 10

In the practice of the present invention computational fluid dynamics (CFD) and structural analysis of the shipboard launcher 10 was performed. The analysis considered that the flow of rocket exhaust through the launcher 10 is a nonsteady, compressible flow of two gaseous materials (air and exhaust) with entrained aluminum oxide. The CFD models ranged from fairly simple ones that use pipe flow approximations in a one dimensional approach to more complicated models with two and three independent spatial dimensions. The goal of CFD was to provide pressure data for the mechanical design of the launcher 10 and heat fluxes for the thermal design. The CFD results are shown in FIG. 9.

FIG. 9 illustrates a reverse image 112 of the CFD computer result for the flow of rocket exhaust through the launcher 10. The flow of FIG. 9 originates in the throat of the rocket motor nozzle 12A. The flow expands through the nozzle 12 losing pressure and gaining speed. Some of the flow is cut off by the port 24A, creating a gun effect that augments the thrust of the rocket motor. The flow is compressed and turned by shock waves and by the hemispherical shaped cup 24. The flow then expands into the uptakes, that is, the annular space between the first and second enclosures 26 and 28, where the pressure is quite low, allowing, in part, for a lightweight design of the launcher 10. Further testing related to the heat occurring during the launcher of a missile was conducted and the results of which are shown in FIG. 10.

FIG. 10 illustrates a plot 114 representative of the data obtained from a nine-inch diameter shipboard launcher 10 and shows the nondimensional Nusselt number (Nu/Nu) plotted against the hydraulic diameter in the annular region, that is, the space between the first and second enclosures 26 and 28. The hydraulic diameter is defined as being four times the cross-sectional area divided by the wetted perimeter of the annular region. The Nusselt number is a measure of the heat transfer rate from the flow to the shipboard launcher 10 providing a semi-empirical method for correlating data. Once the Nusselt number relationship is known, it is possible to predict the heat transfer for other designs and new rocket motors. The Nusselt is related to the Reynolds number which is used to predict drag or head loss. The Nusselt number at a given location of the wall of a duct (that is, the annular space between the first and second enclosures 26 and 28) is defined as:

$$N = \frac{q}{\Delta T}\frac{D}{k} \tag{1}$$

where q=the heat flux into the wall

D=diameter

ΔT=difference between the centerline and wall temperatures of enclosures 26 and 28 k=thermal conductivity of the gas

The Nusselt numbers of FIG. 10 were determined by analyzing thermocouple data to determine heat flux and used a computer process to generate recovery temperatures and thermal conductivities. The latter two quantities could not be measured directly. The plot 114 shows that the heating is much more intense in the entrance region of the annulus, that is, the space between the first and second enclosures 26 and 28. The results shown in FIG. 10 are in agreement with entrance region Nusselt numbers commonly used for other compressible flow situations.

It should now be appreciated that the present invention provides a shipboard launcher 10 having a self-contained gas management system and each launcher 10 providing a complete launching system for the missile it contains. The launcher 10 uses concentric cylinders to support the weapon, guide its initial flight, and provide gas management.

Although the invention has been described relative to specific embodiments thereof, there are numerous variations and modifications that will be readily apparent to those skilled in the art in the light of the above teachings. It is, therefore, to be understood that within the scope of the appended claims, the invention may be practiced other than as specifically described.

What we claim is:

1. A launcher with no moving parts and having means for collecting and dispersing exhaust gases of a launchable device having an exhaust outlet, said means comprising:

a first enclosure having a wall that extends longitudinally and has interior and exterior surfaces with the interior surface encompassing and housing said launchable device;

support means having first and second faces separated from each other by a first predetermined distance to define an exhaust discharge region with one face thereof being affixed to said exterior surface of said first enclosure;

a second enclosure having a wall that extends longitudinally and has interior and exterior surfaces with the interior surface affixed to the other face of said support means; and a cup having a central portion and a rim that mates with said wall of said second enclosure;

stem portions having means for being connected to opposite sides of said wall of said second enclosure and being spaced apart from each other to define a port, said port being located relative to said cup and in operative relationship with said exhaust outlet to allow exhaust gases of said launchable device to pass through said port and to be directed into said exhaust discharge region by said cup; and wherein said first and second enclosures are cylindrical and each has a bore with a predetermined width extending lengthwise therethrough for each respective enclosure, and wherein the width of the bore of said second enclosure exceeds the width of said bore of said first enclosure by an amount corresponding to said first predetermined distance plus the thickness of the first enclosure.

2. The launcher having means for collecting and dispersing exhaust gases according to claim 1, further comprising at least one plate dimensioned to snugly fit about and encompass the exterior surface of said second enclosure and having provisions for receiving fastening means.

3. The launcher having means for collecting and dispersing exhaust gases according to claim 1, wherein said exterior surface of said first enclosure has provisions for receiving and holding one of said faces of said support means.

4. The launcher having means for collecting and dispersing exhaust gases according to claim 1, wherein said first enclosure includes at least one retaining member encompassing one end of said first enclosure.

5. The launcher having means for collecting and dispersing exhaust gases according to claim 1, wherein said support means comprises a plurality of slats arranged into a plurality of groups with each group comprising a pair that is spaced apart from each other by a first predetermined distance, and wherein said second enclosure comprises a plurality of sections of a number corresponding to said plurality of groups of slats and which sections are spaced apart from each other by said first predetermined distance and affixed to said pairs of slats, said separated sections providing a plurality of chambers of a number corresponding to said plurality of groups of slats and said chambers being located between said first and second enclosures.

6. The launcher having means for collecting and dispersing exhaust gases according to claim 5, wherein said plurality of groups of slats is of a number four (4).

7. The launcher having means for collecting and dispersing exhaust gases according to claim 5, wherein said plurality of chambers are dimensioned to accommodate the fins of a launchable object.

8. The launcher having means for collecting and dispersing exhaust gases according to claim 5, wherein said plurality of chambers are dimensioned to accommodate the storage of electronic equipment and the passage therein of electrical cabling.

9. The launcher having means for collecting and dispersing exhaust gases according to claim 5, wherein said plurality of chambers are dimensioned to accommodate ducts for the emission and removal of fluids.

10. The launcher having means for collecting and dispensing exhaust gases according to claim 1, wherein said first and second enclosures, said support means, and said cup comprise titanium alloy.

11. The launcher having means for collecting and dispersing exhaust gases according to claim 1, wherein said second enclosure is formed from a plurality of pieces, each piece of said plurality having complementary connecting dimensions relative to each other so that said plurality of pieces may be interconnected to each other to form said second enclosure.

* * * * *